US005516093A

United States Patent [19]

Ballard et al.

[11] Patent Number: 5,516,093

[45] Date of Patent: May 14, 1996

[54] APPARATUS METHOD FOR CENTERING AND ALIGNING SHEETS

[75] Inventors: Michael D. Ballard, Sandy Hook; Joseph H. Marzullo, Brookfield; Mark E. Sievel, Newtown, all of Conn.

[73] Assignee: Pitney Bowes Inc., Stamford, Conn.

[21] Appl. No.: 300,908

[22] Filed: Sep. 6, 1994

[51] Int. Cl.[6] ..... B65H 9/00

[52] U.S. Cl. ..... 271/240; 271/254

[58] Field of Search ..... 271/240, 248, 271/253, 254, 234; 198/836.1, 836.2, 836.3

[56] References Cited

U.S. PATENT DOCUMENTS

| | | | |
|---|---|---|---|
| 2,809,831 | 10/1957 | Nordquist | 271/240 |
| 3,182,994 | 5/1965 | Huth | 271/240 |
| 3,361,426 | 1/1968 | Pawlikowski et al. | 271/240 X |
| 4,155,440 | 5/1979 | Bogdanski et al. | 198/399 |
| 5,091,754 | 2/1992 | Abe et al. | 271/240 X |
| 5,195,737 | 3/1993 | Ifkovits, Jr. et al. | 271/35 |
| 5,255,903 | 10/1993 | Parsons et al. | 271/10 |

FOREIGN PATENT DOCUMENTS

| | | | |
|---|---|---|---|
| 648616 | 2/1994 | Japan | 271/240 |

*Primary Examiner*—David H. Bollinger

*Attorney, Agent, or Firm*—Robert H. Whisker; Melvin J. Scolnick

[57] ABSTRACT

An apparatus and method for centering and aligning sheets. The apparatus includes a D-roller assembly for cyclically engaging and transporting sheets and a centering and aligning mechanism for centering the lining sheets which is synchronized with the operation of the D-roller assembly so that the centering and aligning mechanism acts upon the sheets before the sheets are engaged by the D-roller assembly. The centering and aligning mechanism includes a pair of elements extending parallel to, and symmetrically from the center-line of, the path followed by the sheets and the elements cycle from first positions inward to second positions separated by approximately the width of the sheets so that sheets positioned between the elements are centered a aligned. Movement of the elements is synchronized with the D-roller assembly by a pair of complementary oppositely faced barrel cams mounted on a common shaft with the D-roller assembly. To center and align the sheets the D-roller assembly is rotated to cyclically open and close its nip and the elements are cyclically moved between the first positions and the second positions so that the elements reach the second positions while the nip is open, remain in the second positions until the nip closes, and return to the first position before the nip begins to close again. Sheets are fed into the D-roller assembly and between the elements during each cycle while the nip is open and the elements are approximately in the first positions.

10 Claims, 2 Drawing Sheets

APPARATUS METHOD FOR CENTERING AND ALIGNING SHEETS

BACKGROUND OF THE INVENTION

The subject invention relates to a method and apparatus for centering and aligning sheets as they are transported along a path. By "sheets" herein is meant the substantially planar, rectangular objects. More particularly the subject invention relates to a method and apparatus for aligning sheets of paper or accumulations of sheets of paper, which may be folded or unfolded, envelopes, completed mailpieces and the like as they are transported through a mail production system.

As such sheets are transported through various types of mail production equipment they will frequently become skewed or off-center with respect to the path along which they are transported. This is particularly a problem where the sheets are intended to be inserted into an envelope to form a completed mailpiece. Thus, such mail production systems frequently include one or more mechanisms for centering and aligning these sheets with respect to the path as they are transported. Typically such centering and aligning mechanisms would require a sensor which would generate a signal when a sheet approached the mechanism and some form of motor or actuator responsive to the signal for driving a relatively complex, multi-element mechanism to center and align the sheet. Additionally, such mechanism frequently required that transport of the sheet be halted while the centering and alighting operation was carried out.

Thus it is an object of the subject invention to provide a simple mechanism for centering and aligning sheets as they are transported along a path.

BRIEF SUMMARY OF THE INVENTION

The above object is achieved and the disadvantages of the prior art are overcome in accordance with the subject invention by means of a method and apparatus which includes a D-roller assembly for cyclically engaging and transporting sheets and a centering and aligning mechanism for centering and aligning the sheets. The apparatus also includes a synchronizing mechanism for synchronizing operation of the D-roller assembly and the centering and aligning mechanism so that the centering and aligning mechanism acts upon the sheets before the sheets are engaged by the D-roller assembly. (As is well known in the art, D-roller assemblies are roller assemblies which include a roller which is particularly cut away so that the nip of the roller assembly opens and closes cyclically. Thus a sheet may be freely inserted into the roller assembly while the nip is open and then engaged and transported as the nip closes.)

In accordance with one aspect of the subject invention, the centering and aligning mechanism includes a pair of elements extending parallel to the path and symmetrically spaced from the center-line of the path, where the elements cycle from first positions inwards to second positions where the elements are separated by approximately the width of the sheets, so that sheets positioned between the elements are centered and aligned.

In accordance with another aspect of the subject invention, the elements are fixed to a mechanical linkage for controlling the movement of the elements where the mechanical linkage links the elements to a cam, the cam rotating synchronously with the D-roller assembly.

In accordance with another aspect of the subject invention, the cam is a barrel cam rotating on a common shaft with at least one D-roller in the D-roller assembly and the barrel cam has a cam surface consisting of an outer flat portion, an inner flat portion and a pair of sloped portions connecting the flat portions; where the linkage follows the cam surface to cycle the elements between the first positions when the linkage bears upon the outer flat portion and the second positions when the linkage bears upon the inner flat portion; and the barrel cam is fixed in an angular relationship to the D-rollers such that the elements reach the second position before the D-roller assembly engages the sheets, remain in the second position as the sheets are transported and return to the first position before a next of the sheets is fed into the apparatus.

In accordance with another aspect of the subject invention, the apparatus further includes a complementary barrel cam mounted on the shaft and oppositely faced to the barrel cam; the barrel cam and the complementary barrel cam imparting symmetrically opposed movement to the elements through the linkage.

In operation the D-roller assembly is rotated to cyclically open and close its nip and the pair of elements is cyclically moved between the first positions and the second positions so that the elements reach the second positions while the nip is open, remain in the second positions until the nip closes, and return to the first position before the nip begins to close again. Sheets are fed into the D-roller assembly and between the elements during each cycle while the nip is open and the elements are approximately in the first positions.

Thus it can be seen that the subject invention advantageously achieves the above object and overcomes the disadvantages of the prior art by providing a mechanism which will center and align sheets as they are fed while operating continuously. Other objects and advantages of the subject invention will be apparent to those skilled in the art from consideration of the attached drawings and the detailed description set forth below.

DETAILED DESCRIPTION OF PREFERRED EMBODIMENTS OF THE SUBJECT INVENTION

Conventional supporting structure, which forms no part of the invention per se, is not shown.

Figure 1:
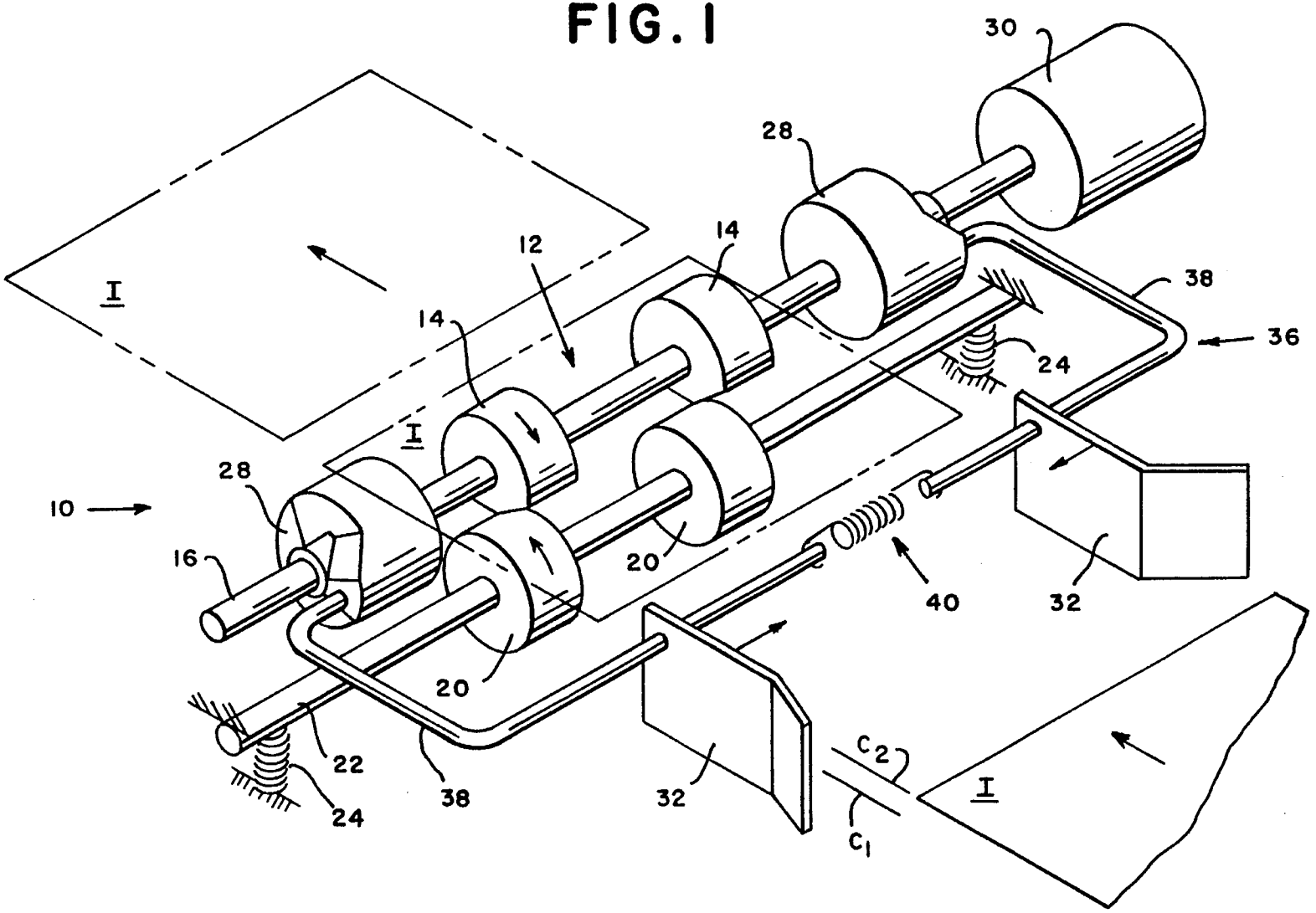
FIG. 1 shows a semi-schematic perspective view of an embodiment of the subject invention.
Figure 2A:
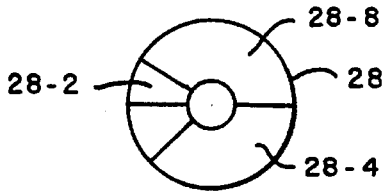
FIGS. 2*a* and 2*b* show a top plan view and an elevation view of a barrel cam used in the embodiment of FIG. 1.
Figure 2B:
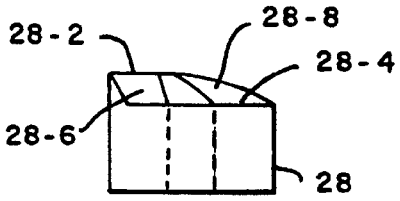

FIG. 1 shows a semi-schematic representation of a preferred embodiment of the subject invention. A sheet I, which in a preferred embodiment is an insert comprising one or more folded sheets having a maximum thickness of a approximately three millimeters, is fed into apparatus 10 by any convenient mechanism. (Not shown) Apparatus 10 includes a D-roller assembly 12 which includes a pair of D-rollers 14 fixed to shaft 16 and a corresponding pair of idler rollers 20 fixed to shaft 22 which is resiliently supported by spring mounts 24.

A pair of complementary, oppositely faced barrel cams 28 are fixed to shaft 16 outboard of D-rollers 14. Shaft 16 and D-rollers 14 and barrel cams 28 are all rotated by motor 30 with the sense shown in FIG. 1.

Apparatus 10 also includes a pair of centering and aligning elements 32 which are equally spaced from the center line of the path along which sheet I is transported and which extend parallel to that path. Elements 32 cycle between outer positions $C_2$ and inner positions $C_2$ as linkage 36 is moved by barrel cams 28. Linkage 36 includes a pair of cam followers 38 each of which bears upon one of barrel cams 28 and a spring assembly 36 which provides a restoring force tending to move elements 32 towards the center line of the path. The cam surfaces of barrel cams 28 are shaped to synchronize the motion of elements 32 with the rotation of D-roller assembly 12 as will be described further below.

In accordance with other embodiments of the subject invention, by modifying linkage 36 in a manner which would be readily apparent to those skilled in the art. Barrel cams 28 may be replaced by lobe cams. In still other embodiments of the subject invention elements 32 may be driven by an actuator separate from motor 30 in any convenient manner, such as by a cam or rack and pinion gear assembly. In these still other embodiments synchronization between elements 32 and D-roller assembly 12 would be provided by a timing signal generated by any convenient means such as a sensor or encoder. Details of the design of such embodiments would readily apparent to those skilled in the an and need not be discussed further here for an understanding of the subject invention.

Turning now to FIGS. *2a*, *2b*, 3 and 4 a more detailed description of the synchronization of D-roller assembly 12 and elements 32 will be given.

FIGS. *2a* and *2b* show a top plan view and an elevation of one of barrel cams 28. The cam surface of each of barrel cams 28 consists of 4 segments: an outer flat segment 28-2, an inner flat segment 28-4 and a pair of sloped segments 28-6 and 28-8 connecting segments 28-2 and 28-4, which segments are traversed by cam followers 38 as barrel cams 28 rotate.

(Note that segment 26-8 is longer and has a shallower slop to reduce the load on motor 30 as elements 32 are driven outwards to positions $C_1$ against the resistance of spring assembly 40.) At zero degrees cam followers 38 bear upon the boundaries between segments 28-2 and 28-6.

Figure 3:
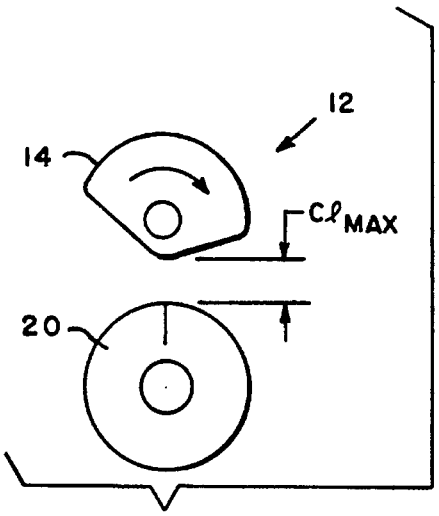
FIG. 3 shows a schematic representation of the operation of a D-roller assembly used in the embodiment of FIG. 1.
Figure 4:
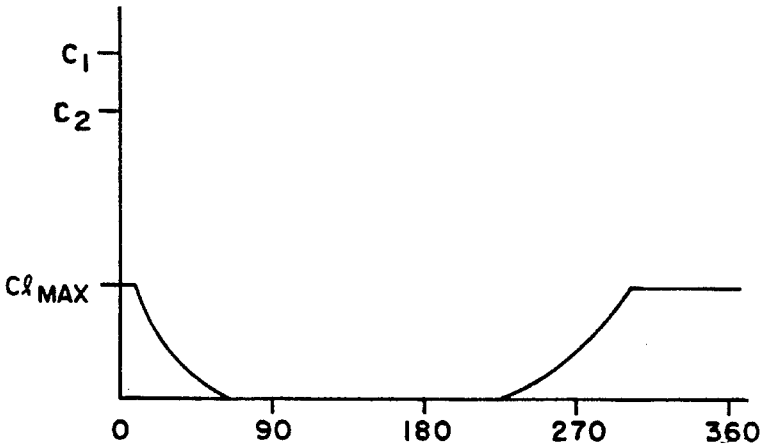
FIG. 4 shows a timing diagram for the embodiment of FIG. 1.

Turning to FIG. 3, at zero degrees clearance C l s at a maximum, as shown in FIG. *3a*. As D-roller assembly 12 rotates to approximately ten degrees clearance C begins to decrease, as shown in FIG. 4. Thus sheet I can be inserted between D-rollers 14 and idler rollers 20 without being constrained, and can be centered and aligned by the action of elements 32. When clearance Cl reaches approximately 3 millimeters (the nominal thickness of sheet I) D-rollers 14 engage sheet I and begins to drive it forward. Arc 14-2 of D-rollers 14 is selected to have a length sufficient to drive sheet I forwarded for engagement with take-away rollers (not shown), or other suitable means for further processing, which need not be described further here for an understanding of the subject invention.

FIG. 4 shows a timing diagram of the relationship between the movement of elements 32 and clearance C of D-roller assembly 12 normalized to the rotation of shaft 16. At zero degrees elements 32 are at positions $C_1$ and clearance Cl is at a maximum. As shaft 16 rotates cam followers 38 traverse segment 28-6 and elements 32 move inwards as clearance Cl decreases. At approximately 45 degrees elements 32 reach positions $C_2$, and at approximately 80 degrees clearance Cl reaches zero, slightly before that, but after elements 32 reach positions $C_2$, centering and aligning sheet I, D-roller assembly 12 engages sheet I and begins to drive it forward. From approximately 45 degrees to approximately 180 degrees elements 32 remain at positions $C_2$ as cam followers 38 traverse segments 28-4. From approximately 80 degrees until approximately 225 degrees D-rollers 14 bear upon sheet I and continued to drive it forward. From approximately 180 degrees cam followers 38 traverse segments 28-8 and elements 32 move outwards to positions $C_1$. At approximately 220 degrees, sheet I having been engaged the take away rollers (not shown), clearance Cl begins to open, reaching its maximum at approximately 290 degrees, and remaining at the maximum as D-roller assembly 12 returns to zero degrees. At approximately 330 degrees cam followers 38 return to segments 28-2 and elements 32 reach positions $C_1$. At this point elements 32 are at their widest separation and clearance Cl is at its maximum and a next sheet I may be feed into apparatus 10.

Apparatus 10 may operate continuously, with timing signals generated from D-roller assembly 12 as described above to synchronize insertion of sheets I, or motor M may be a single cycle motor which makes one complete revolution in response to a signal generated when a sheet I is fed into apparatus 10.

The above descriptions have been provided by way of illustration only, and other embodiments of the subject invention will be apparent to those skilled in the art from consideration of the detailed descriptions set forth above and the attached drawings. Accordingly limitations on the scope of the subject invention are to found only in the claims set forth below.

What is claimed is:

1. An apparatus for centering and aligning sheets, comprising:

a) A D-roller assembly for cyclically engaging and transporting sheets;

b) centering and aligning means for centering and aligning said sheets; and c) synchronizing means, including a cam rotating synchronously with said D-roller assembly, for synchronizing operation of said D-roller assembly and said centering and aligning means so that said centering and aligning means acts upon said sheets before said sheets are engaged by said D-roller assembly.

2. An apparatus as described in claim 1 wherein said centering and aligning means comprises a pair of elements extending parallel to a path along which said sheets are transported and symmetrically spaced from a center-line of said path, said elements cycling from first positions inwards to second positions separated by approximately a width of said sheets, whereby sheets between said elements are centered and aligned.

3. An apparatus as described in claim 2 wherein said elements are fixed to a mechanical linkage for controlling the movement of said elements.

4. An apparatus as described in claim 3 wherein said mechanical linkage links said elements to said cam.

5. An apparatus as described in claim 4 wherein said cam is a barrel cam, said barrel can rotating on a common shaft with at least one D-roller comprised in said D-roller assembly.

6. An apparatus as described in claim 5 wherein said barrel cam comprises a cam surface, said cam surface further comprising an outer flat segment, an inner flat segment and a pair of slopped segments connecting said flat portions; and said linkage following said cam surface to cycle said elements between said first position when said linkage bears upon said outer flat portion and said second position when said linkage bears open said inner flat portion; said barrel cam fixed in an angular relationship to said D-roller such that said elements reach said second position before said D-roller assembly engages said sheets, remains in said second position as said sheets are transported and returns to said first position before a next of said sheets is fed into said apparatus.

7. An apparatus as described in claim 6 further comprising a second complimentary barrel cam mounted on said shaft oppositely faced to said barrel cam; said barrel cam and said complimentary barrel cam imparting symmetrically opposed movement to said elements through said linkage.

8. An apparatus as described in claim 1 wherein said cam is a barrel cam mounted on a common shaft with at lease one D-roller comprised in said D-roller assembly.

9. An apparatus as described in claim 8 wherein said synchronizing means further comprises second, complimentary barrel cam oppositely faced on said shaft.

10. An apparatus as described in claim 9 wherein said synchronizing means further comprises a mechanical linkage for imparting symmetrical opposed movements to a pair of elements of said centering and aligning mean, said elements extending parallel to a path along which said sheets are transported and being symmetrically spaced from a center-line of said path.

* * * * *